United States Patent [19]

Neiman

[11] Patent Number: 4,796,921

[45] Date of Patent: Jan. 10, 1989

[54] HIDDEN PRINTING

[75] Inventor: Ralph Neiman, Dayton, Ohio

[73] Assignee: Penny-Ohlmann-Neiman, Inc., Dayton, Ohio

[21] Appl. No.: 9,782

[22] Filed: Feb. 2, 1987

[51] Int. Cl.[4] ..... B42D 15/00

[52] U.S. Cl. ..... 283/91; 283/902; 428/203

[58] Field of Search ..... 283/91, 94, 902; 428/203; 427/7, 162, 258; 162/134, 140

[56] References Cited

U.S. PATENT DOCUMENTS

| | | | |
|---|---|---|---|
| 736,035 | 8/1903 | Stevenson . | |
| 1,002,600 | 9/1911 | Morris et al. . | |
| 1,167,566 | 1/1916 | Jenkins . | |
| 1,428,278 | 9/1922 | Dow . | |
| 1,622,329 | 3/1927 | MacCordy | 283/91 |
| 3,640,009 | 2/1972 | Komiyama . | |
| 4,175,776 | 11/1979 | Ranauro | 283/91 |
| 4,307,899 | 12/1981 | Hoppe . | |
| 4,432,630 | 2/1984 | Haas . | |
| 4,504,084 | 3/1985 | Jauch | 283/91 |
| 4,506,916 | 3/1985 | Kuhi | 283/91 |
| 4,522,429 | 6/1985 | Gardner et al. | 162/140 |
| 4,568,141 | 2/1986 | Antes | 283/91 |
| 4,632,429 | 12/1986 | Gardner et al. | 283/91 |

*Primary Examiner*—Paul A. Bell

*Attorney, Agent, or Firm*—Jacox & Meckstroth

[57] ABSTRACT

A hidden message device and a method by which a hidden message device is produced. A translucent sheet, of any desired color and of any desired material has a hidden message applied thereto by means of a coating material, such as ink, which has the same color as the sheet. Thus, the hidden message portion of the sheet is substantially opaque and/or presents a significant contrast in translucency. The hidden message is not observable until the sheet is positioned between the observer and a source of light. If desired the hidden message may be applied to the sheet in locations among printed material which is applied to the sheet in a conventional manner in a color or colors different from the color of the sheet. Thus, the conventional printed material is readily observable, but the hidden message is observable only when viewed in front of a source of light.

4 Claims, 1 Drawing Sheet

HIDDEN PRINTING

BACKGROUND OF THE INVENTION

In numerous types of situations and environments it is desirable or necessary to provide a sheet which carries a hidden message or indicia. For example, in some merchandizing schemes a hidden message is present on a sheet and can be read only after a coating is removed by scratch removal of the coating or by some other method of removal of the coating. Some types of hidden messages on a sheet appear only after a chemical solution is applied to the sheet. Some types of hidden messages which are carried by a sheet appear only after a reaction occurs in the message when the sheet is subjected to artificial or natural light. Some types of hidden messages which are carried by a sheet are made to appear only after the sheet is subjected to a significant temperature change. Some types of hidden messages which are carried by a sheet are made readable only when observed in a special kind of light rays. Some types of hidden messages which are carried upon a sheet are made visible for reading only when viewed through special optics. Several other methods for applying and for reading hidden messages have been created. However, all of the known methods for applying and/or for viewing hidden messages have been relatively expensive to apply and/or inconvenient to use.

It is therefore an object of this invention to provide a method of applying a hidden message to a sheet by which the process is relatively inexpensive.

Another object of this invention is to provide a sheet with a hidden message in which the hidden message can be readily observed by the use of normal light rays.

Another object of this invention is to provide such a method which creates high quality products.

Other objects and advantages of this invention reside in the construction and application of parts, the combination thereof, the method of production and the mode of use, as will become more apparent from the following description.

SUMMARY OF THE INVENTION

This invention comprises sheet with a hidden message or indicia and a method of creating hidden indicia upon a sheet, such as a sheet of paper or the like.

A substantially translucent sheet of any color is used. A hidden message or hidden indicia are applied to the sheet by means of a coating material, such as ink, which has the same color as the sheet. The sheet is thus opaque and/or has a significant contrast in translucency only in the portions to which the ink has been applied. However, the hidden message or indicia are not visible until the sheet is positioned between the observer and a light source. When this occurs, light rays flow through all portions of the sheet except the portions to which the ink is located and the hidden message or indicia can be observed.

DETAILED DESCRIPTION OF THE INVENTION

In this invention a substantially translucent sheet, such as a sheet of paper or the like, of any color, may be employed.

Figure 1:
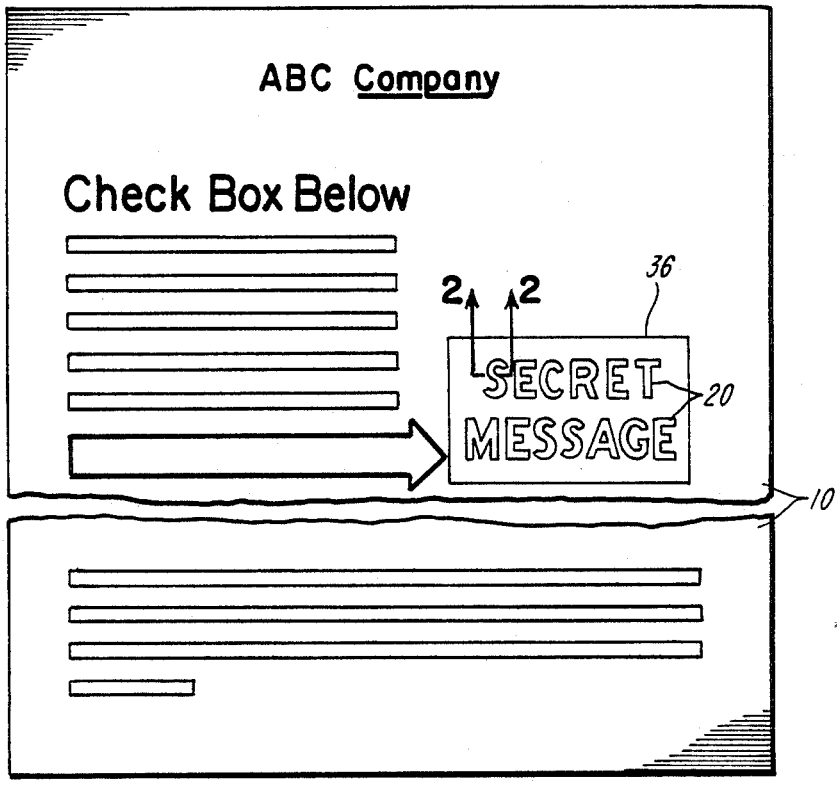
FIG. 1 is a plan view, with parts broken away, of a sheet to which a hidden or secret message has been applied in accordance with this invention.
Figure 3:
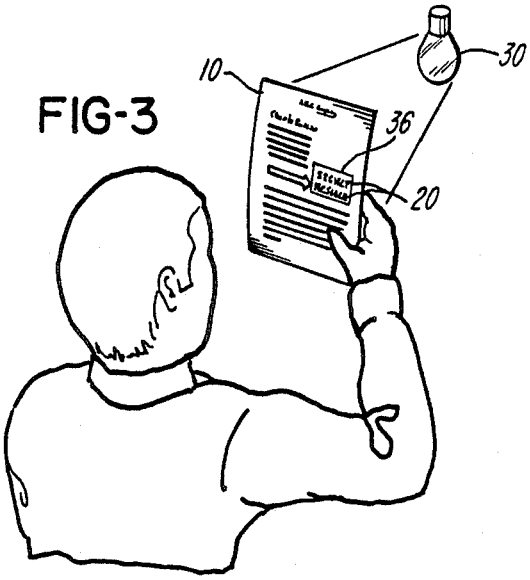
FIG. 3 is a perspective view, drawn on a much smaller scale than FIGS. 1 and 2, illustrating the manner by which a hidden or secret message which has been applied by the method of this invention can be observed.
Figure 2:
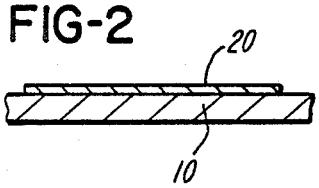
FIG. 2 is an enlarged fragmentary sectional view, taken substantially on line 2—2 of FIG. 1.

FIG. 1 shows a translucent sheet 10 which may be of any desired color. A secret message 20 is applied to the surface of the sheet 10 by printing the secret message 20 in a coating material, such as ink, the coating material being of the same color as the sheet 10. The portions of the sheet 10 which are covered by the ink are thus opaque and/or present a significant contrast in translucency. However, the secret message cannot be observed until the sheet 10 is viewed with the sheet 10 between the observer and a light 30, as illustrated in FIG. 3. The light intensity required to observe the secret message is dependent upon the type of sheet, color of the translucent portion 36 of the sheet, and physical characteristics of the ink and other factors. In FIGS. 1, 2, and 3 the secret message 20 is applied to a rectangular portion 36 of the sheet 10 which carries no other printing.

Figure 4:
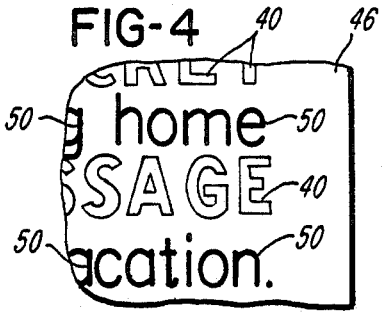
FIG. 4 is a plan view drawn on a larger scale than the other figures, illustrating the manner by which a hidden or secret message may be positioned among words which are not hidden.

FIG. 4 shows a secret message 40 applied to a sheet 46 by means of a coating material, such as ink, which is the same color as the sheet 46. However, the ink of the same color is applied to a portion of the sheet 46 which has a message 50 printed in a conventional manner in a color different from the color of the sheet 46. Thus, the conventionally applied message 50 is readily observable, but the secret message 40 is not observable until the sheet 46 is positioned between an observer and a light, such as the light 30 shown in FIG. 3.

Although the preferred embodiment of the structure and method of this invention has been described, it will be understood that within the purview of this invention various changes may be made in the form, details, proportions, methods and arrangement of parts, the combination thereof, and the mode of use and method of application which generally stated consist in a structure and/or method within the scope of the appended claims.

The invention having thus been described, the following is claimed:

1. An article having a secret message which can be conveniently identified, comprising a sheet of translucent paper which is white in color and capable of transmitting natural light, a first portion of the sheet having printed thereon a first ink which has a color different from white and which forms visually identifiable information, a second portion of the sheet being free of the first ink and having printed thereon a white ink, said second portion of the sheet being less translucent in the area of the white ink, and said white ink forming a secret message, and said secret message being visually readable when viewing natural light through the second portion of the sheet.

2. An article having a secret message which can be conveniently identified, comprising a sheet of translucent paper of predetermined color and capable of transmitting natural light, a first portion of said sheet having printed thereon a first ink having a color different from said predetermined color of said sheet and forming visually identifiable information, a second portion of said sheet being free of said first ink and having printed thereon a second ink having the same color as said predetermined color of said sheet, said second portion of said sheet being less translucent in the area of said second ink and said second ink forming said secret message, and said secret message being visually readable when viewing natural light through said second portion of said sheet.

3. The method of producing an article having a secret message which can be conveniently identified, comprising:

providing a sheet of translucent material of a predetermined color and capable of transmitting natural light, printing a first ink upon a first portion of the sheet, the first ink having a color different from said predetermined color of the sheet and forming visually identifiable information, providing the sheet with a second portion which is free of the first ink, printing on the second portion of the sheet a second ink which is the same color as the predetermined color of the sheet and forming the second ink into a secret message, whereby the area of the second ink is less translucent and the secret message is visually readable when viewing natural light through the second portion of the sheet.

4. The method of producing an article having a secret message which can be conveniently identified, comprising providing a sheet of translucent material which is white in color and capable of transmitting natural light, printing a first ink upon a first portion of the sheet, the first ink having a color which is different from white and forming visually identifiable information, providing the sheet with a second portion which is free of the first ink, printing on the second portion of the sheet a second ink which white in color, and forming the white ink into a secret message, whereby the area of the second ink is less translucent and the secret message is visually readable when viewing natural light through the second portion of the sheet.

* * * * *